US006757942B2

(12) United States Patent
Matsui et al.

(10) Patent No.: US 6,757,942 B2
(45) Date of Patent: Jul. 6, 2004

(54) TAPE WITH SNAP FASTENER

(75) Inventors: Shoji Matsui, Toyama-ken (JP); Hideyuki Matsushima, Taipei (TW)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/414,244

(22) Filed: Apr. 16, 2003

(65) Prior Publication Data

US 2003/0196300 A1 Oct. 23, 2003

(30) Foreign Application Priority Data

Apr. 17, 2002 (JP) ..... 2002-115274

(51) Int. Cl.[7] ..... A44B 17/00

(52) U.S. Cl. ..... 24/114.4; 24/114.05; 24/324; 24/662; 24/692; 24/697.1

(58) Field of Search ..... 24/114.4, 114.05, 24/662, 693, 114.6, 588, 114.1, 692, 696, 697.1, 689, 324

(56) References Cited

U.S. PATENT DOCUMENTS 2,895,199 A * 7/1959 Jones ..... 24/662
3,243,858 A * 4/1966 Melanson ..... 24/693
3,613,181 A * 10/1971 Taylor ..... 24/662
3,869,766 A * 3/1975 Raymond ..... 24/662
4,805,272 A * 2/1989 Yamaguchi ..... 24/693
6,260,240 B1 * 7/2001 Akashi et al. ..... 24/114.4

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

A tape with snap fastener in which fixing strength of a fastener to a tape main body is secured and which is excellent in durability by eliminating a possibility that the fastener may contact directly the tape upon engagement and disengagement and has good external design performance. A base portion is fixed to front and rear surfaces of the tape main body of the male or female synthetic resin snap fastener, and a substantially cylindrical engaging protruding portion projects vertically from the base portion. A ring-like continuous concave groove portion, which has the same center as the base portion and an inner diameter exceeding the inner diameter of the engaging protruding portion, is provided on any one of front and rear surfaces of the base portion. The engaging protruding portion and the continuous concave groove portion have depth reaching the tape main body.

6 Claims, 4 Drawing Sheets

TAPE WITH SNAP FASTENER

BACKGROUND OF THE INVENTON

1. Field of the Invention

The present invention relates to a tape with snap fastener in which the snap fastener made of thermoplastic synthetic resin material is fixed to front and rear surfaces of a tape or the like by integral molding. More particularly, the present invention relates to a tape with snap fastener in which the snap fastener is molded integrally on the front and rear surfaces of a tape or the like by penetration of synthetic resin material due to injection pressure at the time of injection molding without forming a fastener attaching hole in the tape or the like.

2. Description of the Prior Art

Conventionally, tapes with snap fasteners made of thermoplastic synthetic resin material have been used generally as disclosed in, for example, Japanese Patent Application Laid-Open Nos. 55-2469 and 62-155805. According to a manufacturing methods thereof, a hole is preliminarily made in a fastener attaching portion of a tape in order to fix the tape and the fastener firmly. Then, a cavity in the front and rear surfaces is charged with molten resin material through the hole so as to integrally mold a snap fastener of a desired configuration.

According to the above-described Japanese Patent Application Laid-Open No. 62-155805, in order to prevent a section around the tape attaching hole from being waved largely or deflected upon molding of the snap fastener, the section around the tape attaching hole is nipped with plural tape fixing pins protruding from an inner face of each cavity at a portion in which the section around the tape attaching hole is inserted within the cavity of each of upper and lower molds and then, molten resin material is injected so as to mold a fastener integrally on the section around the tape attaching hole.

However, as described above, formation of the fastener attaching hole in the tape and the tape fixing pins in the cavity is troublesome, and particularly formation of the attaching hole causes increase in forming processes, thereby increasing production cost. To avoid this problem, for example, Japanese Utility Model Application Laid-Open No. 56-16311 and Japanese Patent Application Laid-Open Nos. 10-33211 and 2001-149117 have disclosed such a method which employs a tape having large gaps and in which the fastener is molded integrally on the tape by filling the cavities on the front and rear sides with molten resin material through the gaps without forming the fastener attaching hole in the tape and the tape fixing pins in a mold cavity.

Further, the male fastener disclosed in the above-described Japanese Patent Application Laid-Open No. 2001-149117 has a bottomed cylindrical shape, thereby leading to reduction of material cost. Forming the male fastener in a bottomed cylindrical shape, which is produced by cutting out a flange portion from the male fastener, means that the entire thickness of the male fastener in its appearance, i.e., the amount of protrusion of the male engaging protrusion which projects from the tape surface, can be reduced without changing the protrusion height of the male engaging protrusion from the tape surface. Moreover, according to this publication, no resin is disposed in the center of the bottom portion of the male fastener so that the tape is exposed inside and outside the bottom portion. This is probably for reducing material cost further.

The male fastener disclosed in the above-described Japanese Patent Application Laid-Open No. 2001-149117 merely has the bottomed cylindrical shape with no flange portion at its bottom and the outside diameter of the engaging protrusion projecting from the tape is substantially equal to an inner diameter of an engaging/disengaging opening edge of a mating female fastener, which receives the male fastener. On the other hand, the mating female fastener presents an ashbowl shape without any flange portion. Thus, in the fastener comprising a pair of male and female parts as described in this publication, the outer diameter of the female fastener is larger than the outside diameter of the male fastener.

Consequently, as shown in FIG. 6 and FIGS. 12(D) and 12(E) of this publication, when the male and female fasteners are engaged with each other, the female fastener comes into contact with the tape surface of the male fastener side. As a result, the tape tends to be damaged by excessive rubbings due to frequent engaging/disengaging operations.

The shape of the male fastener of the same publication is a simple circle having the same outer diameter as that of the male engaging protrusion in which the shape at the bottom on an opposite side to the engaging protrusion is substantially cylindrical. The outer surface of the male fastener does not allow anything but a mere concave portion to be formed in its center portion. Therefore, improvement from the design aspect is limited, so that this male fastener is inferior to a metallic fastener in terms of its appearance.

Moreover, according to the same publication, if a ring-like expanded portion is formed on an opening edge inner face of the engaging protrusion of the male fastener, the inner face of the engaging protrusion can be used as an engaging/disengaging portion of the female fastener. In this case, as described above, it is troublesome to find out a combination of male and female counterparts which can engage with or disengages from each other from many kinds of fasteners having a simple external surface and configuration. In addition, when the same fastener is attached to clothing, it is difficult to distinguish the male fastener from the female fastener and the male fastener or the female fastener may be mistaken for another.

The present invention has been achieved to solve the problems described above. An object of the invention is to provide a tape with snap fastener in which the fastener is molded thinly and integrally on the tape and which allows the male and female fastener tapes to be selected easily when they are attached to a clothing and eliminates a possibility that the fastener may contact directly the tape when the male and female fasteners are engaged with or disengaged from each other, thereby ensuring an excellent durability and external design performance.

SUMMARY OF THE INVENTION

The above-described problems are solved by a tape with snap fastener according to the basic structure of the present invention, in which at least one male or female synthetic resin snap fastener is molded integrally on the tape, wherein the snap fastener comprises a base portion to be fixed to the front and rear surfaces of the tape and an engaging protruding portion projecting vertically from the base portion. The engaging protruding portion is substantially cylindrical. A ring-like continuous concave groove portion having the same center as the base portion and an inner diameter exceeding the inner diameter of the engaging protruding portion, is provided on any one of front and rear surfaces of the base portion. The engaging protruding portion and the continuous concave groove portion have a depth reaching the tape.

In the snap fastener of this kind, the male fastener comprises the base portion to be fixed to the front and rear surfaces of the tape and the engaging protruding portion projecting from the base portion over a tape face. The male fastener has an expanded portion which engages with or disengages from a female fastener, the expanded portion being provided on the peripheral face of a top end of the engaging protruding portion. Usually, the base portion has a flange portion longer in the diameter direction than the engaging protruding portion. On the other hand, as in the male fastener, the female fastener comprises the base portion to be fixed on the front and rear surfaces of the tape and the engaging protruding portion projecting from the base portion over a tape face. The engaging protruding portion is cylindrical and has a ring-like expanded portion which engages with or disengages from the male fastener, the expanded portion being provided along an opening edge inner face.

According to the present invention, the engaging protruding portion of the male fastener is also formed cylindrically like the engaging protruding portion of the female fastener. The cylindrical shape mentioned here includes a case where the cylinder is divided to two or more sections across a flat plane passing its axis line. Further, according to the present invention, the ring-like concave groove portion having the inner diameter exceeding the inner diameter of the engaging protruding portion is formed around the center of the base portion in any one of front and rear of the base portion. Thus, when the male fastener is molded, a portion corresponding to the bottom face of the cylindrical engaging protruding portion and a tape portion corresponding to the ring-like continuous concave groove portion are supported by parts of a metal mold.

When the ring-like continuous concave groove portion is formed on the surface of the base portion on the protrusion side of the engaging protruding portion, a gate portion, which serves as a molten resin introduction port into a cavity, can be disposed in the center of the base portion of the fastener. Therefore, resin pressure applied to the tape is received by a portion corresponding to the bottom face of the engaging protruding portion and a portion corresponding to the ring-like continuous concave groove portion. Consequently, swing of the tape is eliminated so that molten resin can be filled fully into the cavity. Further, if the ring-like continuous concave groove portion is formed on the surface of the base portion on an opposite side to the protrusion side of the engaging protruding portion, the resin pressure in the cavity is received by deflected portions of the front and rear surfaces of the tape. Consequently, the swing of the tape is suppressed, and molten resin can be filled fully in the cavity. Further, because the surface of the base portion of the fastener is not a mere flat plane, the appearance performance thereof is improved.

According to the present invention, preferably, the ring-like continuous concave groove portion is circular or polygonal. Although the polygonal mentioned here includes ordinary polygons consisting of straight lines such as a regular polygon and a star shape, ring-like shapes obtained by connecting adjacent vertexes of a polygon with curved lines having diversified curvatures are also included. According to the present invention, forming the ring-like concave groove portion having such diversified shapes enriches the appearance performance of the snap fastener. In the meantime, although the aforementioned continuous concave groove portion may be a single ring, it may be formed in multiple-ring form around the same center.

The ring-like continuous concave groove portion may be formed around a base end of the engaging protruding portion or on the surface on an opposite side to the protruding side of the engaging protruding portion. When the ring-like concave groove portion is formed around the base end of the engaging protruding portion, upon engagement of the male fastener with the mating female, the female fastener comes into contact with the base portion so as to engage with the male fastener, and it never contacts the tape. Therefore, the tape is free of damage by abrasion even if the engagement/disengagement of the fastener is repeated, thereby securing durability. Also, when the ring-like continuous concave groove portion is formed on a surface of the base portion on an opposite side to the protrusion side of the engaging protruding portion, upon engagement of the fasteners, the ring-like continuous concave groove portion is exposed on the surface of a fastener attaching object material. Thus, disharmony feeling about the appearance design thereof is eliminated unlike a mere flat plane or ring-like fastener.

According to the present invention, it is preferable that, as in the continuous concave, plural hollow portions, having a depth reaching the tape groove and arranged intermittently in a ring form, are provided on the surface on an opposite side to the base portion corresponding to the ring-like continuous concave groove portion. With such a configuration, when the male fastener is molded, the tape is nipped and supported at plural faces by a bore forming protrusion in the engaging protruding portion projecting into the cavity, a ring-like protrusion for forming the ring-like concave groove portion, and plural protrusions for forming concave portions, so that swing or moving of the tape is eliminated. Consequently, a tape with male fasteners having a more stabilized configuration and structure is manufactured. Further, forming the configuration of the hollow portion into a shape having a design performance improves its appearance.

Preferably, the tape consists of woven or knitted fabric, and weaving patterns or stitches having gaps large enough for molten resin to pass through are formed at least at a fastener attaching portion thereof. Molten resin passes through the gaps smoothly so that it is filled in the cavity uniformly upon molding of the male fastener. Accordingly, no special fastener attaching hole has to be formed in the tape, so that a base having a stable structure is formed on both the front and rear surfaces of the tape.

DESCRIPTION OF THE PREFERRED EMBODIMENTS

Hereinafter, preferred embodiments of the present invention will be described in detail with reference to the accompanying drawings.

Figure 1A:
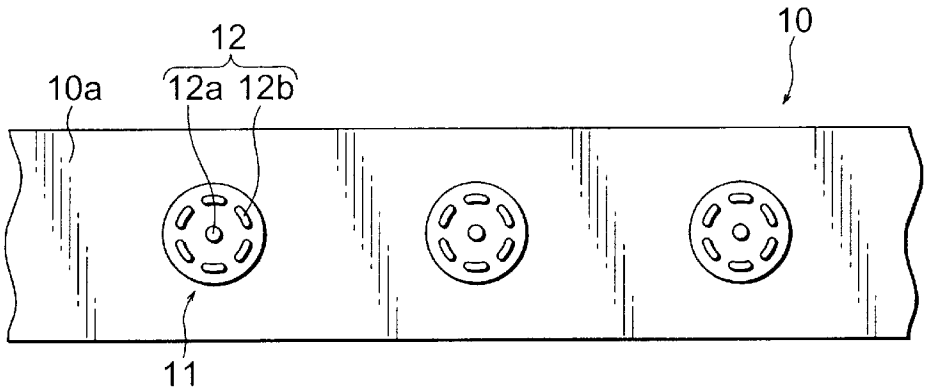
FIG. 1 is diagrams of front and rear surfaces of a tape with male snap fasteners according to a typical embodiment of the present invention.
Figure 1B:
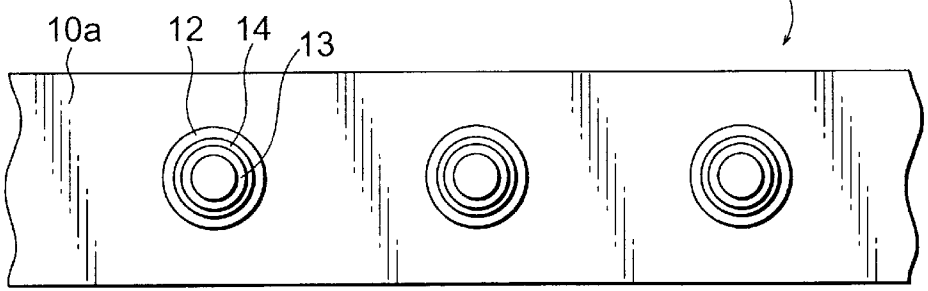
Figure 2A:
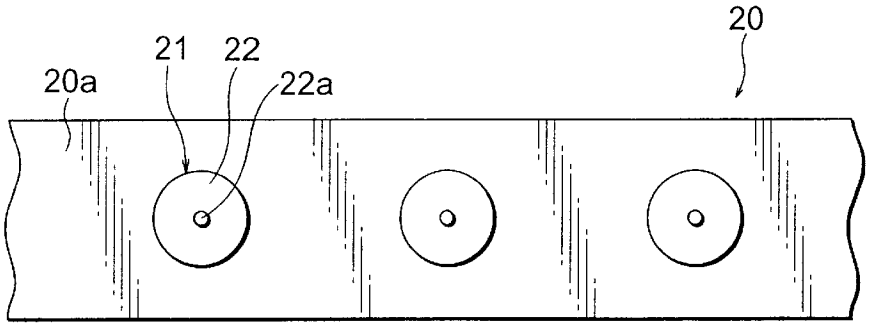
FIG. 2 is diagrams of front and rear surfaces of a tape with female snap fasteners according to a typical embodiment of the present invention.
Figure 2B:
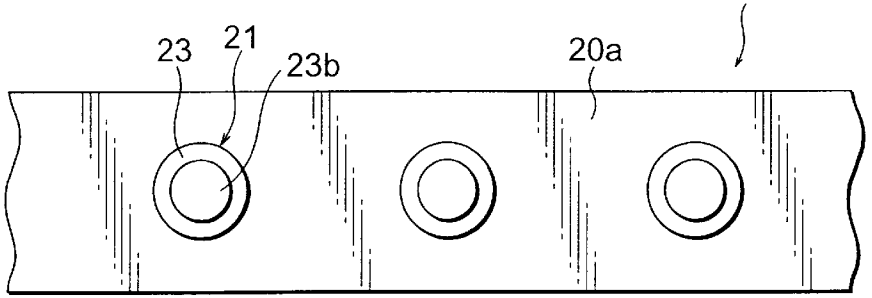

FIGS. 1A and 1B show the front and rear surfaces of a tape with male snap fasteners of the present invention. FIGS. 2A and 2B show the front and rear surfaces of a tape with female snap fasteners. The male and female fasteners 11, 21 are formed integrally on the front and rear surfaces of a tape main body 10*a* by injection molding with thermoplastic synthetic resin material.

Figure 3:
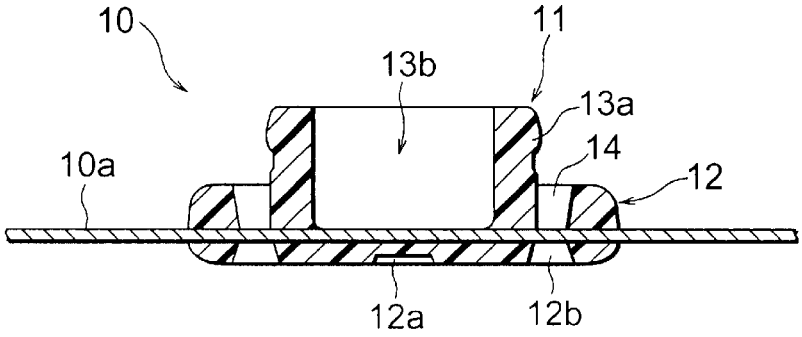
FIG. 3 is a partial sectional view of the tape with the male snap fasteners.

A surface of a base portion 12 of the male fastener 11 is exposed on the surface of the tape 10 with male snap fasteners and a small concave portion 12*a* is formed in the center of the base portion 12 thereof while plural (six in the figure) hollow portions 12*b* are formed at a predetermined pitch on a coaxial circle on a periphery thereof. On the other hand, a cylindrical engaging protruding portion 13 is provided protrudedly from a center portion of the base portion 12 on the rear face of the tape with male snap fasteners 10. A ring-like expanded portion 13*a* which is expanded outward is provided on an outer peripheral face of a tip portion of the engaging protruding portion 13. A ring-like continuous concave groove portion 14 is formed on the surface of the base portion around the protruding base end of the engaging protruding portion 13. Portions of the tape main body 10*a* for fixing the fastener are exposed on the hollow portions 12*b* and a continuous concave groove portion 14, and on a bottom face of the engaging protruding portion 13 as shown in FIG. 3.

Consequently, the concave portion 12*a* formed in the center of the male fastener 11 and the plural hollow portions 12*b* arranged intermittently around the concave portion 12*a* are exposed on the surface of the male fastener 11. Also, the ring-like continuous concave groove portion 14 is exposed around the engaging protruding portion in the rear face of the male fastener 11. Thus, an external appearance of this fastener can be made approximate to an ordinary metallic male fastener. In addition, if the male fastener 11 is colored in a different color from the tape 10 and the hollow portion 12*b* is formed in a flower shape, a flower pattern is formed entirely, thereby intensifying design performance. The hollow portion 12*b* and the continuous concave groove portion 14 are formed on circles having the same axis and diameter on the front and rear surfaces of the base portion 12.

In order to form a bore portion 13*b* in the engaging protruding portion 13, the hollow portion 12*b* and the ring-like continuous concave groove portion 14 of the base portion, protrusions with shapes corresponding to each of these are projected at corresponding positions of the molding cavity (not shown) for the fastener. Then, upon molding, a tape main body 10*a* is supported with a top face of the protrusion for molding the bore portion 13*b* in the engaging protruding portion 13 while the tape main body 10*a* is nipped by top faces of the molding protrusions corresponding to the hollow portions 12*b* and the ring-like continuous concave groove portion 14 of the base portion. Molten resin injected from an injection nozzle (not shown) is introduced into the cavity from the center of the small concave portion 12*a* formed in the center of the base portion 12 from a gate through a runner (not shown) of a metal mold.

In this way, upon molding of the fastener, parts of the tape main body 10*a* are supported with parts of the mold around and within the cavity and nipped at peripheries of supported faces. Thus, a fastener molding portion of the tape main body 10*a* is never swung or deformed by the injection pressure, so that the fastener is molded on the tape with the tape main body 10*a* maintained in a very stable. Consequently, a high-quality tape 10 with fasteners having a sufficient fixing strength to the tape main body 10 is obtained.

Figure 4:
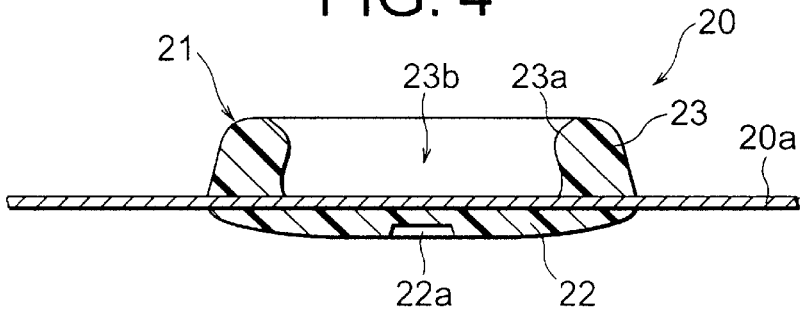
FIG. 4 is a partial sectional view of the tape with the female snap fasteners.
Figure 5:
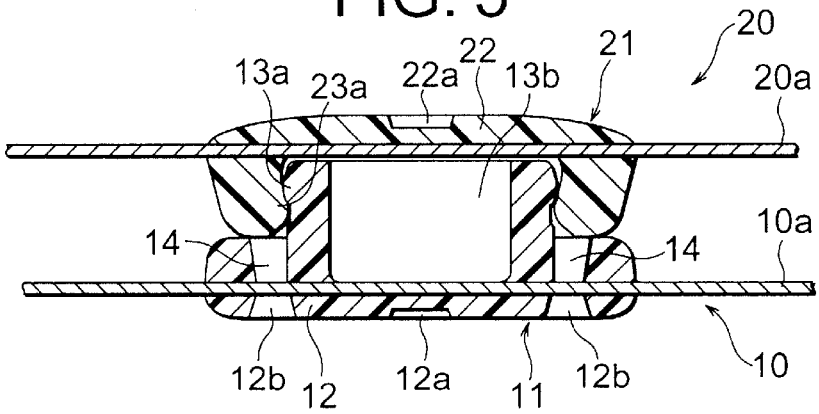
FIG. 5 is a partial sectional view showing an engagement state of the male and female fasteners of the tape with the snap fasteners.

On the other hand, the female fastener 21 of a tape 20 with female snap fasteners consists of a disc-like base portion 22 and a cylindrical engaging protruding portion 23 having the same outer diameter as the base portion 22 as shown in FIGS. 2 and 4. Only a small concave portion 22*a* is formed in a center portion of the surface of the base portion and a part of the tape main body 20*a* is exposed on the rear face of the base portion 22. A ring-like continuous expanded portion 23*a*, which engages with or disengages from the expanded portion of the engaging protruding portion 13 of the male fastener 11, is formed on an inner peripheral edge of a tip portion the engaging protruding portion 23. The female fastener 21 is molded in the same way as molding of the male fastener except in that the ring-like continuous concave groove portion and the plural concave portions are molded upon formation of the male fastener.

The male and female fasteners 11, 21 of this embodiment are remarkably different from each other in their external appearance as described above. Therefore, when the tapes 10, 20 with male/female snap fasteners are attached to clothing by sewing or the like, the tapes 10, 20 with male/female snap fasteners are not attached by mistaking one for another.

As the male and female tape main bodies 10*a*, 20*a* of this embodiment, a warp knitting tape with a gauge of 10–31 pieces/1.77 cm and course number of 25–55 pieces/1.77 cm, consisting of chain knitting yarns, tricot knitting yarns and weft in-laid yarns composed of multi-filaments of 50–300 d, is used (not shown). The tape may be composed of woven fabric if gaps of weaving patterns are large enough for molten resin to pass through. The gaps do not have to be formed in the entire tape and it is sufficient that the tape contain the aforementioned gaps at least at fastener-molding positions. A single gap needs to have an area of 0.01 to 0.25 $mm^2$ and its knitting structure and weaving density are not limited to any particular ones. Further, fiber for tape material is not restricted to natural fiber and synthetic fiber may be used if it has a melting point higher than those of material for the male and female snap fasteners 11, 21.

When the male snap fastener 11 and the female snap fastener 21 having the above-described structures are engaged with each other, a tip of the engaging protruding portion 23 of the female fastener 21 comes into contact with the peripheral face of the ring-like continuous concave groove portion 14 of the male fastener 11. Consequently, when engaging the male and female snap fasteners 11, 21 with each other, the female fastener 21 does not come into contact with the tape main body 10*a*, thereby protecting the tape main body 10*a* from being worn and damaged.

Figure 6:
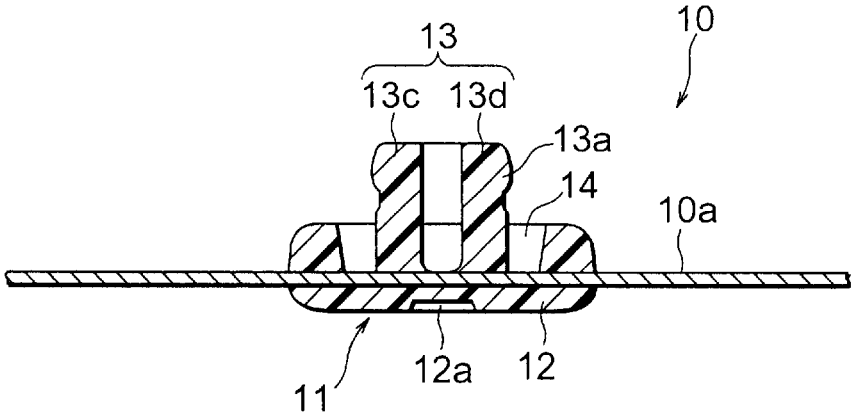
FIG. 6 is a partial sectional view showing a modification of the male fastener fixed to the tape with male snap fasteners.

FIG. 6 shows a modification of the tape 10 with male snap fasteners of the above-described embodiment. According to this modification, the engaging protruding portion 13 of the male fastener 11 is not simply cylindrical but divided into two parts to engaging protruding pieces 13*c*, 13*d*, which are located on opposite sides of a flat plane passing its axial line. The surface of the base portion 12 on an opposite side to the protrusion side of the engaging protruding portion 13 is a flat plane except the peripheral edge portion of the base portion 12 and a small concave portion 12*a* in the center thereof with no plural hollow portions 12*b* formed. The ring-like continuous concave groove portion 14 is formed on the surface of the base portion around a base end of the engaging protruding portion 13. Although not shown, the continuous concave groove portion 14 may be formed on the surface of the base portion 12 on the opposite side to the protrusion side of the engaging protruding portion 13.

Figure 7:
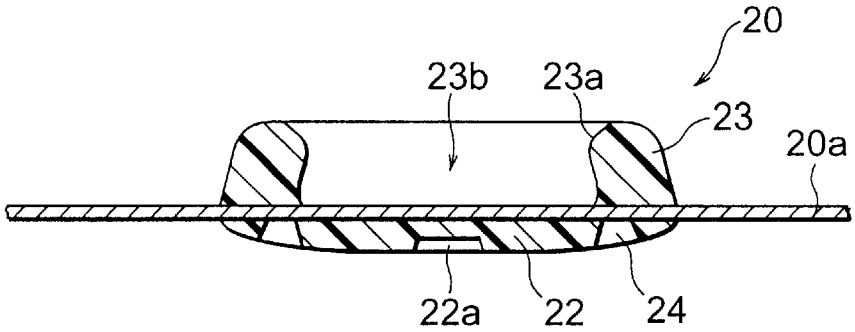
FIG. 7 is a partial sectional view showing a modification of the female fastener fixed to the tape with male snap fasteners.

FIG. 7 shows a modification of the female snap fastener 21 of the above-described embodiment. According to this modification, a ring-like continuous concave groove portion 24 is formed on the surface of the base portion 22 on an opposite side to the protrusion side of the engaging protruding portion 23. The ring-like continuous concave groove portion 24 has its inner diameter outside the inner peripheral face of the cylindrical engaging protruding portion 23. In order to mold the female fastener 21 having the above-described structure integrally on the tape main body 20*a*, the tape main body 20*a* is nipped at its front and rear surfaces by the molding protrusion of the cylindrical engaging protruding portion 23 and the molding protrusion of the ring-like continuous concave groove portion 24, both of which protrude in a cavity of a metal mold (not shown), such that their diameters are shifted from each other. Thus, compared with a case where no molding protrusion of the continuous concave groove portion 24 is provided, the tape main body 20*a* is prevented effectively from being swung or deformed by resin pressure at the time of injection of molten resin, thereby providing a product having a sufficient fixing strength and stabilized configuration.

What is claimed is:

1. A tape with snap fastener in which at least one male or female synthetic resin snap fastener is molded integrally on a tape main body, comprising the snap fastener having a base portion to be fixed to front and rear surfaces of the tape main body and a substantially cylindrical engaging protruding portion projecting vertically from the base portion, wherein a ring-like continuous concave groove portion, which has the same center as the base portion and an inner diameter exceeding the inner diameter of said engaging protruding portion, is formed on any one of front and rear surfaces of the base portion, and said engaging protruding portion and said continuous concave groove portion have depth reaching the tape main body.

2. A tape according to claim 1, wherein said continuous concave groove portion is circular or polygonal.

3. A tape according to claim 1, wherein said continuous concave groove portion is formed around a protruding base end of said engaging protruding portion.

4. A tape according to claim 1, wherein said continuous concave groove portion is formed on a surface of the base portion on an opposite side to a protruding side of said engaging protruding portion.

5. A tape according to claim 1, wherein plural hollow portions having a depth reaching the tape main body and arranged intermittently in a ring form are provided on a surface at an opposite side to said base portion corresponding to said continuous concave groove portion.

6. A tape according to claim 1, wherein said tape main body consists of woven or knitted fabric and weaving patterns or stitches having gaps large enough for molten resin to pass through are formed at least at a fastener attaching portion thereof.

* * * * *